US007080673B2

(12) United States Patent
Pollack et al.

(10) Patent No.: US 7,080,673 B2
(45) Date of Patent: Jul. 25, 2006

(54) QUICK LNG OFFLOADING

(75) Inventors: Jack Pollack, Houston, TX (US); Hein Wille, Eze (FR)

(73) Assignee: SBM-IMODCO, Inc., Houston, TX (US)

( * ) Notice: Subject to any disclaimer, the term of this patent is extended or adjusted under 35 U.S.C. 154(b) by 0 days.

(21) Appl. No.: 11/101,341

(22) Filed: Apr. 7, 2005

(65) Prior Publication Data

US 2006/0080973 A1 Apr. 20, 2006

Related U.S. Application Data

(60) Provisional application No. 60/566,680, filed on Apr. 30, 2004.

(51) Int. Cl.
*B65B 1/04* (2006.01)

(52) U.S. Cl. ..... 141/387; 141/284; 141/82; 441/3; 62/50.2; 62/53.2

(58) Field of Classification Search ..... 141/387, 141/284, 82, 98; 441/3–5; 62/50.1, 50.2, 62/53.1, 53.2; 405/59
See application file for complete search history.

(56) References Cited

U.S. PATENT DOCUMENTS 6,973,948 B1 * 12/2005 Pollack et al. ..... 141/387
6,979,147 B1 * 12/2005 Wille et al. ..... 405/8
6,997,643 B1 * 2/2006 Wille et al. ..... 405/53

* cited by examiner

*Primary Examiner*—Steven O. Douglas
(74) *Attorney, Agent, or Firm*—Leon D. Rosen

(57) ABSTRACT

A system of the type wherein LNG from a tanker (30) is offloaded to a moored vessel (16), which has a regas unit (36) which heats the LNG to transform it into gaseous hydrocarbons, and which has a pump unit (38) that pumps the gaseous hydrocarbons to a consumer (46) such as an onshore gas distribution facility. The system is constructed to enable more rapid tanker unloading so the tanker is released earlier to sail back to a pickup location. The moored vessel has a thermally insulated LNG storage facility such as LNG tanks (100), with a capacity to store all LNG not regassed during offloading of the tanker. The regas unit has sufficient capacity to regas all LNG received in one tanker load, before the tanker returns with another load of LNG.

9 Claims, 4 Drawing Sheets

QUICK LNG OFFLOADING

CROSS-REFERENCE

Applicant claims priority from U.S. provisional application Ser. No. 60/566,680 filed Apr. 30, 2004.

BACKGROUND OF THE INVENTION

Gaseous hydrocarbons, which are hydrocarbons that are gaseous at mild environmental temperatures such as 20° C. and atmospheric pressure, are often transported great distances by tanker in liquid form as LNG (liquified natural gas). To keep the gas liquid, it is stored on the tanker at a low temperature such as −160° C. in highly thermally insulated tanks. At the tanker offloading destination, the LNG is offloaded to a receiving station where it is regassed (heated to turn it into a gas) and stored for later use.

Proposed prior art offloading stations include a large fixed platform extending up from the sea floor to a height above the sea surface. Such platform would contain a heating system that regassed the LNG, a pump system that pressurizes the gas, and crew quarters or other crew facilities. The regas unit or system must heat the LNG sufficiently that the gas is warm enough to avoid ice formations around non-cryogenic hoses or pipes that carry the gas, and the pump system must pump the gas to a high enough pressure to inject it into a storage cavern and/or pump the gas to a shore station. A platform that is large enough to carry such gas heating and pumping systems would be expensive.

One large expense in operating such as system is the tanker daily rate, which may be about US $100,000 per day. It is therefore desirable to offload the tanker as rapidly as possible. This leads to the need for the receiving facility to be able to receive and process all LNG received so the tanker can sail away in a short period of time, and so the tanker can return soon thereafter and unload a new load of LNG. This is in addition for the need to be able to construct the receiving facility at minimum cost.

SUMMARY OF THE INVENTION

In accordance with one embodiment of the invention, applicant constructs the receiving facility at low cost and with the ability to quickly receive all LNG from a tanker. The receiving facility includes a moored floating structure or vessel which can directly receive LNG from a tanker, and which holds a regas unit, a pump unit and crew quarters. The cost for a floating vessel that is moored to the sea floor to weathervane with the tanker and that holds the large amount of equipment, is much less that than of a platform.

In shallow waters, where it is difficult to moor a vessel by catenary chains, applicant uses a bare tower with a lower end mounted in the sea floor. The bare tower is used only to moor the vessel, with the regas unit, pump unit and crew quarters all on the vessel.

To minimize the tanker rental costs, applicant constructs the vessel with large capacity LNG storage tanks. The storage tanks are large enough to store all LNG offloaded by the tanker, that has not been regassed by the regas unit at the end of offloading. The cost of LNG storage tanks on the vessel is less than the extra charge for tanker rental so the tanker can wait for the LNG being offloaded to be gassed by the regas unit. The cost of LNG storage tanks is also less than the cost for a very large regas unit, which anyway might be prohibited from full operation by environmental laws.

However, the regas unit is large enough to heat all offloaded LNG before the tanker next arrives with a load of LNG.

The gas produced by regasing offloaded LNG is preferably stored in an underground cavern before being passed though a seafloor pipeline to a consumer such as an onshore gas distribution facility. Metering of gas (measuring and recording the quantity of gas) delivered to the consumer is made by a metering system that lies on the vessel and though which all gas, from the vessel and from the cavern, passes.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
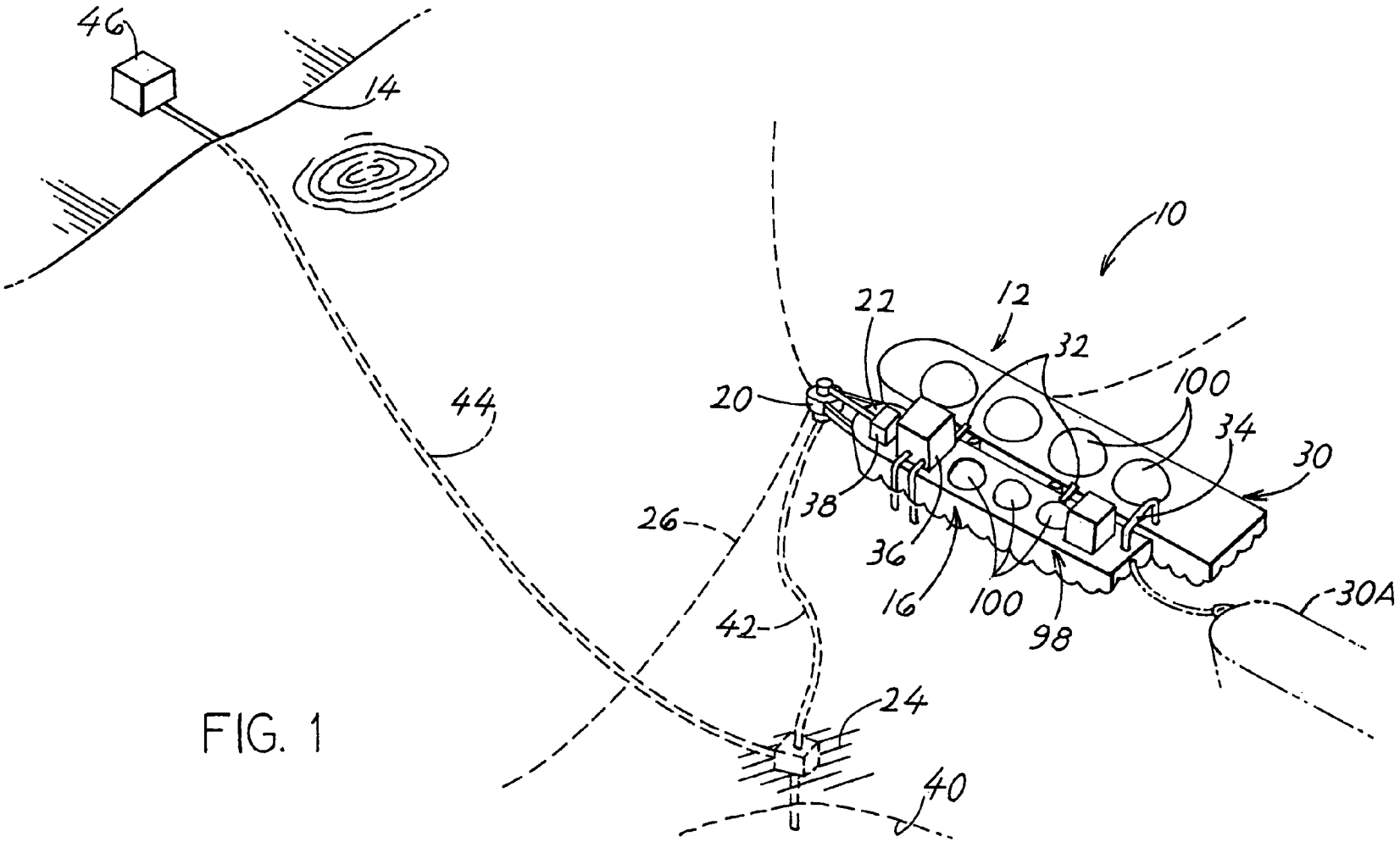
FIG. 1 is an isometric view of an LNG offloading system of one embodiment of the invention.
Figure 2:
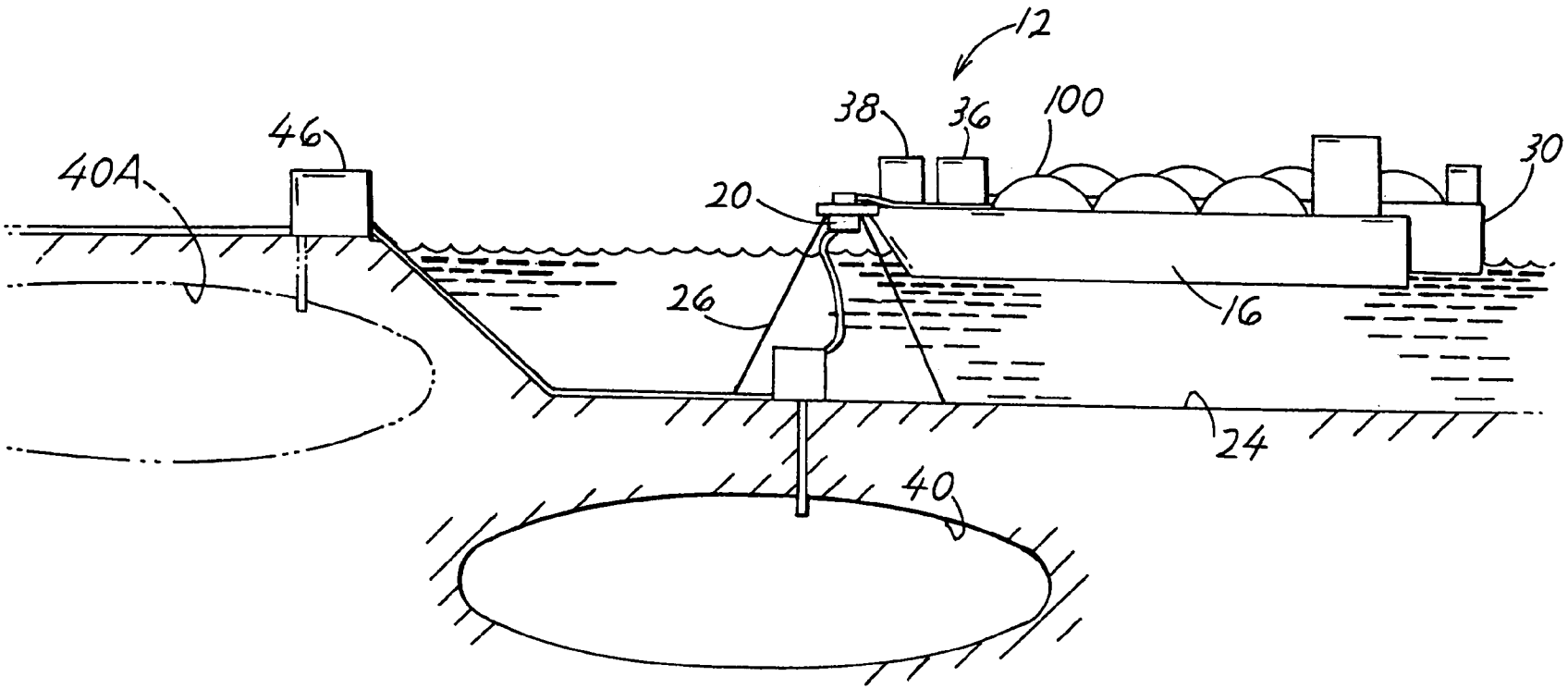
FIG. 2 is a side elevation view of the system of FIG. 1, with an alternate cavern location shown in phantom lines.

FIG. 1 illustrates an LNG offloading system 10 of the present invention, which includes an in-sea structure 12 that lies in the sea and away from the shore 14. The in-sea structure comprises a floating and weathervaning vessel or other floating structure 16 such as in the form of a barge with a turret 20 at or near the vessel bow 22. The barge or other floating structure, is moored to the sea floor 24 by catenary chains 26 that extend in catenary curves to the sea floor and then along the sea floor to an anchor. A tanker 30 that carries LNG (liquified natural gas) is moored to the floating structure as by mooring elements 32, so the tanker weathervanes with the barge. FIG. 1 shows two moored tanker positions at 30 and 30A. An LNG transfer unit 34 which may include a hose and pump or a loading arm, offloads the LNG from the tanker. The floating structure 16 carries a regas system or unit 36 that heats LNG to turn it into gas, and that also carries an injection or pump unit 38 that pressurizes the gas to pump it into an underground cavern 40 that lies under the sea. FIG. 2 shows an underground cavern 40A that does not lie completely under the sea.

When the tanker 30 begins offloading LNG, the regas unit 36 is immediately energized to begin heating the LNG, with the gas being passed through a riser 42. Some or all of the gas is passed though a sea floor pipe 44 (that extends partially along the sea floor) to the consumer, which is shown as an onshore gas distribution facility 46 in FIG. 1, and/or to the cavern 40 for storage before passage to the consumer. It is possible to unload LNG from the tanker at the same rate as the LNG is regassed by the regas unit 36. For example, the regas unit may be able to regas the entire tanker load in four days, and the tanker unloads all of its LNG during those four days. It may take another five days for the tanker to sail to a location where it acquires another full load of LNG and return to the receiver and offloading site of the system 10. During those five days, gas stored in the cavern is released to the consumer, which prefers to receive a largely steady supply.

Apparatus for transferring LNG between the tanker and another structure, such as the transfer unit 34, can be constructed with a large capacity at a moderate cost. Thus, the transfer unit 34 may be able to transfer the entire load of LNG carried by the tanker to the floating structure 16 in one or two days instead of four days, at only a modest additional cost for the transfer unit. This would reduce the required tanker time to transfer a load of LNG. Tanker rental rates are high, such as about US $100,000 per day for a 135,000 ton LNG carrying tanker, so reducing the tanker time for unloading is important. One solution to reduce tanker time is to use a larger regas unit 36. However, regas units use sea water as a source of heat to heat LNG (LNG is at perhaps −160° C.), and there usually are local regulations that limit the rate at which cold water can be released into the environment. Also, if the regas unit produces gas at a higher rate, then the cavern 40 that must store the gas when the tanker is not unloading, must be of larger capacity. Also, a larger regas unit costs more.

In accordance with the present invention, applicant constructs the floating structure 16 so it contains insulated tanks 100 that store LNG. As the tanker unloads LNG, some of it is directly passed to the regas unit 36, and the rest is directed to the LNG storage tanks 100. This allows the tanker to offload during perhaps one or two days, with much of the LNG going to the tanks 100 during offloading. When the tanker sails away, the LNG stored in the tanks is fed to the regas unit. The regas unit gasified all of the LNG over a longer period of time such as during a period of eight days instead of four days. This facilitates compliance with local environmental laws that limit how much cold water can be released and its temperature, reduces the required size of the regas unit 36 and the pressurizing unit 38, reduces the required size of the storage cavern 40, and reduces the tanker rental time for a given transport rate of LNG.

In one example, the tanker carries 1000 tons of LNG, and offloads it during a period of two days. It then sails away and returns in five more days, so the "turn-around time" is seven days. The regas unit 36 has a capacity of 150 tons per day, and therefore requires almost seven days to regas an entire tanker load. The LNG storage capacity provided by the tanks on the floating structure 16 is 700 tons. The storage capacity of the cavern can be small since the regas unit feeds gas into the cavern only slightly faster than gas is withdrawn from the cavern during offloading and the cavern is the sole source of gas to the consumer for less than a day. Applicant has calculated the costs for extra cavern storage capacity (e.g. for 700 tons of natural gas in a gaseous state), and the cost for the same capacity of natural gas in the form of LNG buffer tanks on a floating structure, and finds that the costs are about the same. The benefit of reduced tanker rental time as well as reduced regas unit size and less environmental problems, makes the substitution worthwhile.

The relationship between gas mass A (in tons of LNG) carried by the tanker, the interval B between tanker visits to the floating structure in days, the unloading time period C in days, the regas unit capacity D in tons per day, and the LNG storage capacity E of tanks 100 on the floating structure in tons of LNG is given approximately (within 33% of the actual values) by:

$$E=A-(D\times C), \text{ and}$$

$$D=A/B$$

The LNG tanks on the tanker must be well insulated because any gas that evaporates (without refrigeration) would have to be released into the environment or burned (which is dangerous and costly). The tanks 100 on the receiving floating structure do not have to be well insulated because any gas that evaporates is pumped to the consumer or storage cavern without even passing though the regas unit. In fact, such evaporated gas can be considered part of the output of the regas unit. However, the tanks must be moderately insulated to limit the amount of ice that is formed on the storage tanks from water vapor in the atmosphere, to protect personnel, and to prevent sea water from turning into ice against the vessel.

Figure 4:
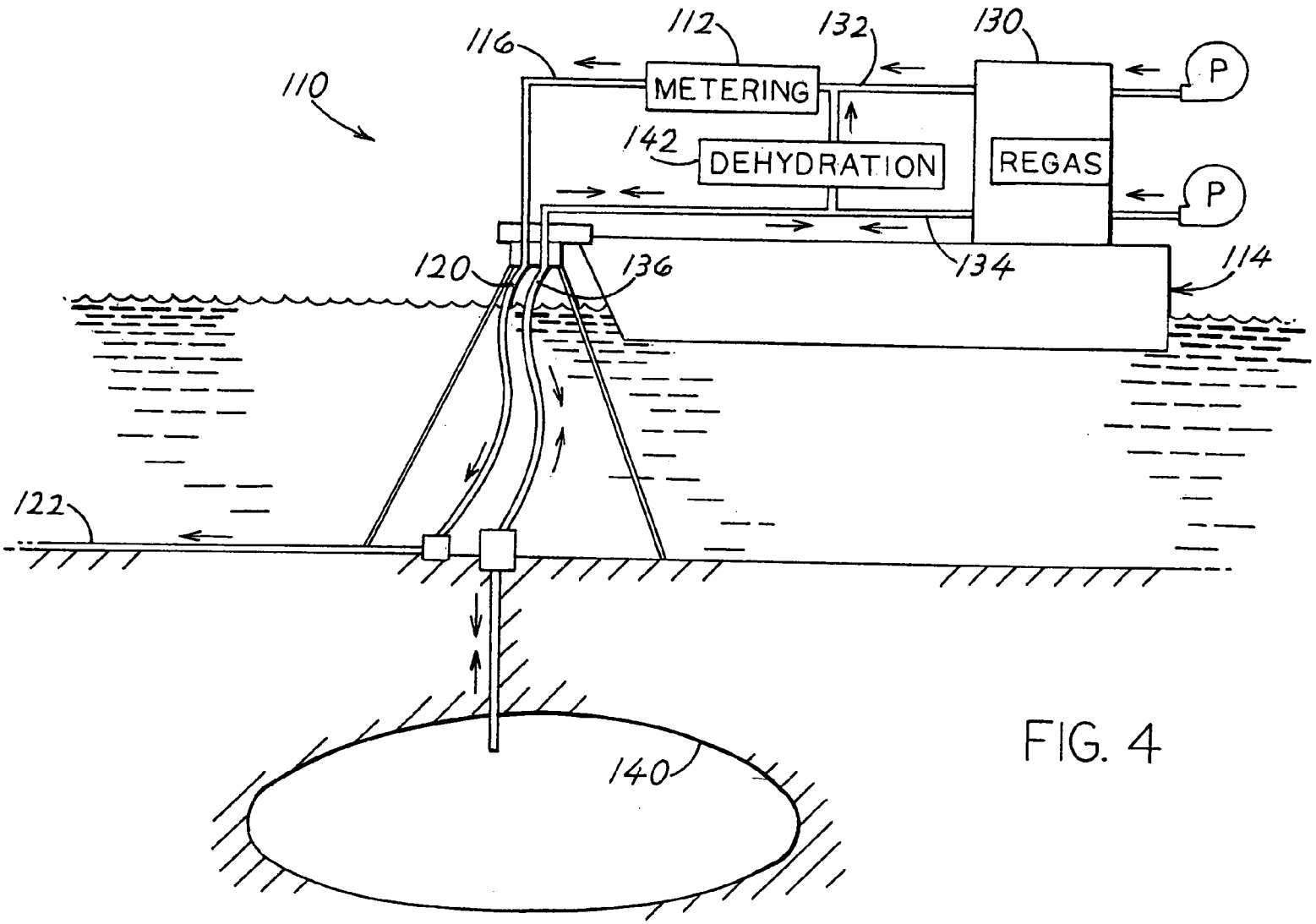
FIG. 4 is a side view of an LNG offloading system of the type illustrated in FIG. 2, but showing a metering facility.

An important aspect in offloading an LNG tanker, regasing the LNG and pressuring it, possibly storing gas in a cavern or in tanks, and carrying the gas to an on-shore facility, is metering of the gas which is measuring the quantity of gas that has been sent to the consumer. An accurate measure of the amount of gas delivered to the consumer such as an onshore facility must be maintained to assure complete payment for the gas. FIG. 4 illustrates a system 110 that includes a metering unit 112 that is located on the floating structure 114. The metering unit measures the amount of gas delivered along a pipe 116 and riser 120 to a sea floor pipeline 122 that extends to the onshore facility such as 42 in FIG. 1.

LNG that exits the regas unit 130 (or that evaporates from an LNG tank) on the floating structure may be released to pass though pipe 132. Such gas then flows directly through the metering unit 112 to flow through pipe 116 to the onshore facility. Alternatively, the gas from the regas unit 130 may be released to flow though a pipe 134 to flow down though a riser 136 to cavern 140 where the gas is stored. When gas is to be withdrawn from the cavern, it flows upward through the same riser 136 (which is being used bidirectionally). The gas then flows through a portion of the pipe 134, though a dehydration unit 142 and an input 143 to the metering unit 112. From there, the gas flows though pipe 116 and to the onshore facility. Thus, the regas and metering units are both positioned on the floating structure, gas can flow from the regas unit directly to shore, or gas can flow to a cavern and then back to the floating structure and through the metering unit to shore.

Applicant notes that LNG coming from the tanker (e.g. 30 in FIG. 1) sometimes may be first boosted in pressure and then sent to the regas unit 130 (FIG. 4), so gas from the regas unit may not have to be further pressurized. Gas from the cavern may have to be pressurized. Gas exiting the regas unit 130 does not contain water, but gas from the cavern sometimes contains water. Since wet gas is very corrosive, the gas is passed through the dehydration unit 142 before flowing to the onshore installation or other consumer.

Figure 3:
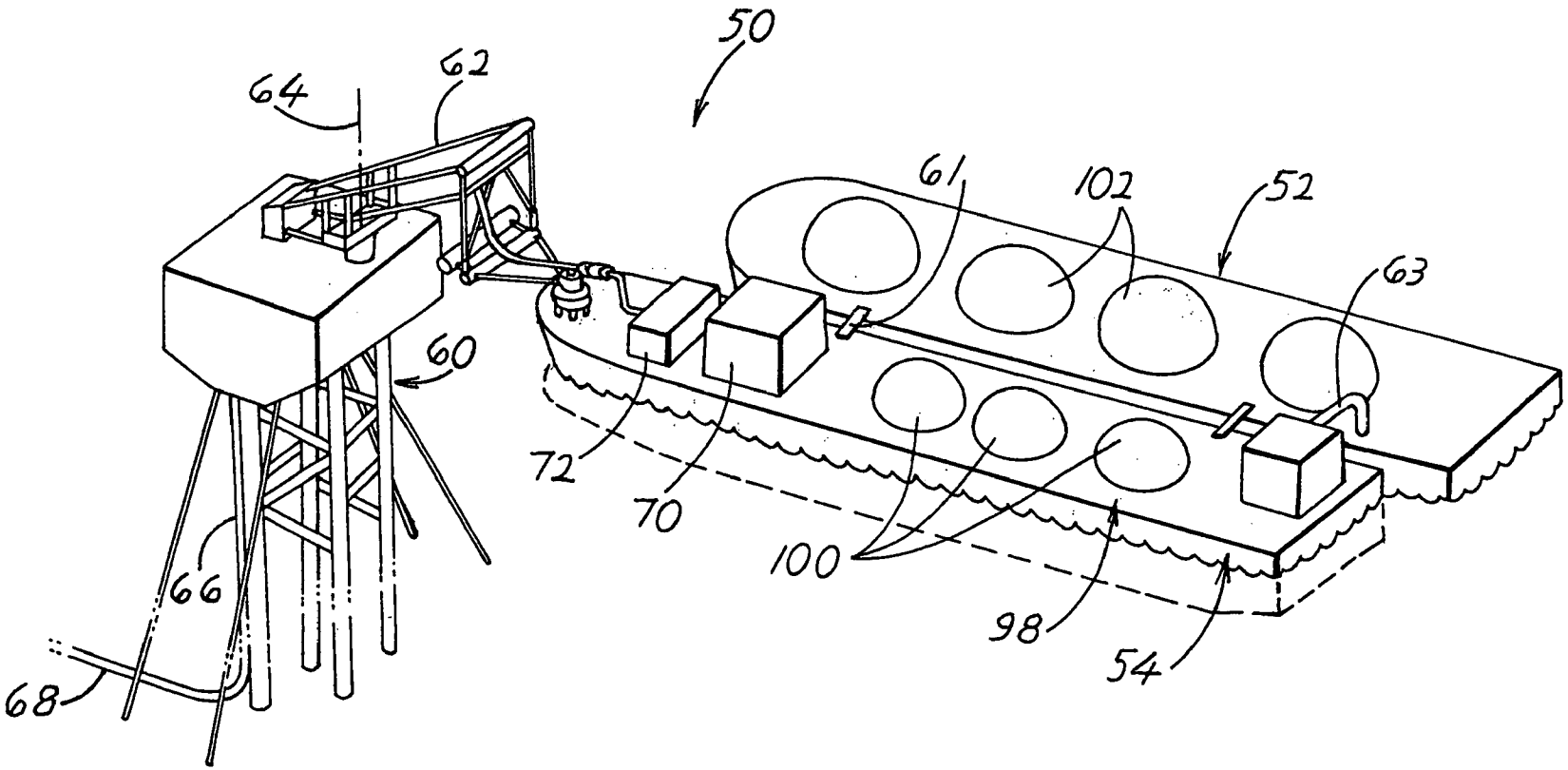
FIG. 3 is an isometric view of an LNG offloading system of another embodiment of the invention, which includes a bare tower to moor and transfer gas from a vessel.

The system 10 of FIG. 1, wherein the weathervaning floating structure 16 is moored by catenary lines to the sea floor, is usually not satisfactory in shallow depths (e.g. less than about 70 meters). In shallow depths, drifting of the floating structure tends to lift the entire length of chain 26 off the sea floor. This can result in a sudden increase in chain tension rather than the gradual increase that is required. FIG. 3 shows another system 50 where a vessel containing LNG storage tanks 100 and a regas unit 70 is moored in a shallow sea location though the use of a bare tower 60 with a lower end 65 fixed to the sea floor and an upper end 67 above the sea surface. The floating structure 54 such as a barge, can weathervane around the tower, and can be attached to a tanker 52 through ties 61 and a cryogenic hose 63, and the barge and tanker weathervane together. The barge can be moored to the tower though a yoke 62 that has an inner end 73 that can pivot about a vertical axis 64 on the tower and that has an outer end 75 that connects to the vessel bow 71, to allow the barge to weathervane. A pipe 66 extends from a fluid swivel at the inner end of the yoke to a seafloor pipe 68. The barge is pivotally connected to the yoke outer end about at least a horizontal axis, to allow the barge to move up and down in the waves. A regas unit 70 that heats cold gas, LNG storage tanks 100, and a pumping unit 72 that pressurizes the heated gas, as well as crew quarters, are located on the barge. A barge large enough to contain such units can be provided at much lower cost than the additional cost of a larger tower to contain such facilities and moor a tanker to itself.

Thus, the invention provides a low cost system for offloading and regasing LNG from a tanker, which minimizes the tanker unloading time, minimizes the required sizes of the regas unit and storage cavern and avoids the release of cold water at an excessive rate. This is accomplished by mounting the regas unit on a floating structure that is moored (directly or indirectly) to the sea. The floating structure includes an LNG storage capacity of 100's of tons, which enables rapid LNG offloading from the tanker and provides other advantages. In a shallow sea location, the system includes a bare tower, and the floating structure is moored to the tower to allow weathervaning and to enable gas to be transferred to a pipe on the tower, but with the LNG storage and the regas unit both mounted on the floating structure.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore system which includes a floating structure that is moored in a sea so the floating structure can weathervane, wherein the system offloads LNG (liquid natural gas) through an LNG transfer unit from a tanker that has an LNG capacity of at least 1000 tons, to said floating structure, and supplies natural gas from said floating structure to a consumer, wherein:

said floating structure carries a regas unit that heats the LNG to produce gaseous natural gas; and said floating structure has a thermally insulated LNG storage facility that includes at least one tank, said storage facility having a storage capacity of a plurality of 100's of tons of LNG, to hold LNG received from the tanker, so the tanker can sail away while LNG in said LNG storage facility is gradually passed through said regas unit.

2. The system described in claim 1 wherein:

said regas unit has a predetermined capacity D in tons per day, to heat LNG received from said tanker to a temperature of at least 0° C.;

said tanker regularly carries a predetermined mass A in tons of LNG to said floating structure, and said system has a transfer capacity to unload said mass from said tanker to said floating structure, in a time period of C in days;

said LNG storage facility on said floating structure has a storage capacity E that is about equal to:

A−(D×C).

3. The system described in claim 2 wherein:

said tanker returns to said floating structure with a mass A of LNG at predetermined intervals B, in days;

the capacity D of said regas unit in tons per day is about equal to said mass A in tons divided by said intervals B in days.

4. The system described in claim 1 wherein said sea is shallow and including:

a bare tower with a lower end fixed to the floor of said sea and an upper end extending above the sea surface, said tower being devoid of LNG storage capacity and of a regas unit;

said floating vessel, having a bow end;

a connector that connects said tower upper end to said floating vessel, said connector having an inner end rotatable on said tower about a primarily vertical axis and having an outer end connected to said vessel bow end.

5. The system described in claim 1 including:

an underground gas storage cavern;

a riser conduit that extends from said vessel to said cavern, so said cavern can store gas produced by said regas unit;

a metering unit on said vessel;

said metering unit has a first input connected to said regas unit and a second input connected to said riser conduit, and said metering unit has an output coupled to said consumer.

6. A method for offloading LNG (liquid natural gas) stored in a tanker to a floating structure to which the tanker is moored, and for heating the offloaded LNG to produce gas for a consumer, comprising:

while offloading LNG from the tanker, directing at least half of the flow of offloaded LNG to at least one thermally insulated LNG tank on said vessel, and directing a majority of the rest of the flow of offloaded LNG to a regas unit that heats the LNG to produce gas;

after offloading said LNG stored in said tanker, sailing the tanker away from said vessel, and gradually flowing LNG stored in said at least one LNG tank to said regas unit.

7. The method described in claim 6 including:

passing some of the gas that exits from said regas unit through a pipeline that extends partially along the sea floor to an onshore consumer;

passing some of the gas that exits from said regas unit to an underground cavern;

when said at least one LNG tank is empty of LNG, passing gas from said underground cavern to said consumer.

8. The method described in claim 6 wherein:

said step of passing gas from said underground cavern to said consumer includes passing gas from said cavern to a metering unit on said vessel and then to the consumer.

9. The method described in claim 8 wherein:

said step of passing gas to an underground cavern, and passing gas from said cavern to a metering unit on said vessel, includes passing gas in opposite directions through the same riser conduit.

* * * * *